US005606941A

United States Patent [19]

Trzmiel et al.

[11] Patent Number: 5,606,941

[45] Date of Patent: Mar. 4, 1997

[54] VARIABLE TIMING CAMSHAFT DRIVE SYSTEM

[75] Inventors: Alfred Trzmiel, Grafenberg; Wolfgang Stephan, Zizishausen; Thomas Alber, Leinfelden-Echterdingen; Andreas Jaksch, Esslingen; Olaf Fiedler, Remchingen, all of Germany

[73] Assignee: Dr.Ing. h.c.F. Porsche AG, Weissach, Germany

[21] Appl. No.: 516,457

[22] Filed: Aug. 17, 1995

[30] Foreign Application Priority Data

Aug. 17, 1994 [DE] Germany ..... 44 29 071.3

[51] Int. Cl.[6] ..... F01L 1/34; F16H 53/04

[52] U.S. Cl. ..... 123/90.15; 123/90.17; 123/90.31; 474/110; 474/111

[58] Field of Search ..... 123/90.15, 90.17, 123/90.31; 474/110, 111, 117, 138

[56] References Cited

U.S. PATENT DOCUMENTS

| | | | |
|---|---|---|---|
| 4,862,845 | 9/1989 | Butterfield et al. | 123/90.15 |
| 4,985,009 | 1/1991 | Schmidt et al. | 474/110 |
| 5,088,457 | 2/1992 | Ferrazzi | 123/90.31 |
| 5,109,813 | 5/1992 | Trzmiel et al. | 123/90.31 |
| 5,117,786 | 6/1992 | Trzmiel et al. | 123/90.31 |
| 5,120,278 | 6/1992 | Trmizel et al. | 474/110 |
| 5,197,420 | 3/1993 | Arnold et al. | 123/90.31 |
| 5,201,289 | 4/1993 | Imai | 123/90.17 |
| 5,297,508 | 3/1994 | Clarke et al. | 123/90.31 |
| 5,323,739 | 6/1994 | Mollers | 123/90.31 |

FOREIGN PATENT DOCUMENTS

| | | |
|---|---|---|
| 0445356B1 | 9/1991 | European Pat. Off. . |
| 4006910C1 | 9/1991 | Germany . |
| 4237785A1 | 5/1993 | Germany . |

OTHER PUBLICATIONS

German Journals DE-Z *ATZ Automobiltechnische Zeitschrift* 93 (1991), vol. 10; *MTZ Motortechische Zeitschrift* 52 (1991), vol. 12.

*Primary Examiner*—Weilun Lo

*Attorney, Agent, or Firm*—Evenson McKeown Edwards & Lenahan, PLLC

[57] ABSTRACT

A variable valve timing camshaft drive system is provided with an adjusting device arranged between the loose end and the load end of a chain which is operative between chain wheels of two parallel camshafts of an internal-combustion engine. For tightening the chain and influencing the relative rotating position of a camshaft—variable valve timing—the device comprises a first hydraulic piston and a second hydraulic piston. The first hydraulic piston can be alternately acted upon by pressure and, in the process, takes up two end positions. By means of a third hydraulic piston, the first hydraulic piston may also be fixed in an intermediate position.

16 Claims, 5 Drawing Sheets

VARIABLE TIMING CAMSHAFT DRIVE SYSTEM

BACKGROUND AND SUMMARY OF THE INVENTION

This invention relates to a device for tightening and adjusting a wind-around drive constructed as a chain by means of which a camshaft of an internal combustion engine drives a second camshaft.

U.S. Pat. No. 4 862 845 relates to a device for tightening and adjusting a chain which is operative between two camshafts of an internal-combustion engine, in which case the relative rotating position of the two camshafts with respect to one another is changed by adjusting the chain. On the one hand, this construction has the disadvantage that the adjusting operation partially takes place by means of high-expenditure gears which makes a largely no-delay change of the relative rotating position of the camshafts more difficult. In addition, for implementing the shown embodiments, comprehensive constructive and empirical tests are required which cause considerable expenses.

European Patent Document EP 0 445 356 A1 (corresponding to German Patent Document DE 40 06 910) discloses a device for tightening and adjusting a camshaft chain drive which comprises hydraulic pistons and which achieves good results with respect to its operation.

The German journals DE-Z *ATZ Automobiltechnische Zeitschrift* 93 (1991), Volume 10 and *MTZ Motortechnische Zeitschrift* 52 (1991), Volume 12, describe a camshaft adjustment with the characteristics of the above-mentioned European Patent Document EP 0 445 356. Accordingly, while the outlet camshaft is positioned in a constant manner, two positions of the inlet camshaft are implemented:

Power position (=initial position); late inlet device EM=120°, KW low valve overlap;

Torque position; early inlet device EM=105°, KW larger valve overlap.

The results of this implemented device for the adjusting of camshafts with respect to power, torque, exhaust emissions and finally fuel consumption underline its targeted construction.

It is an object of the invention to further improve this device while maintaining its basic concept.

According to the invention, this object is achieved by providing an adjusting device for adjusting the position of one of the hydraulic pistons used to adjust the chain.

Principal advantages achieved by means of the invention are that, by means of the adjusting device, in addition to the late position—the basic control time—and the early position—the torque position—a central intermediate position can be selectively utilized.

By means of these three positions, a relatively large bandwidth can be implemented of variable valve timing with the existing engine oil pressure which is similar to a continuous or proportional adjustment, but without the constructional expenditures required for this purpose. These expenditures relate to the sensing system for the actual value detection of the camshaft, to a continuous electromagnetic valve and the holding of the adjuster piston in a defined position. For conventional systems—axial adjusters—additional high-expenditure high-performance oil pumps (>20 bar) are required.

In preferred embodiments of the present invention, the adjusting device comprises another hydraulic piston which can be integrated teleologically at acceptable cost into the hydraulic system comprising two hydraulic pistons. The respective end stop for the third hydraulic piston can be integrated in a simple manner into the existing hydraulic system. Finally, the control of the hydraulic piston takes place in preferred embodiments of the invention by means of a 5/3-way valve which ensures a good as well as secure operation and, together with a lifting magnet actuating it, can be integrated in a simple manner into the housing of the hydraulic pistons.

Other objects, advantages and novel features of the present invention will become apparent from the following detailed description of the invention when considered in conjunction with the accompanying drawings.

DETAILED DESCRIPTION OF THE DRAWINGS

Figure 1:
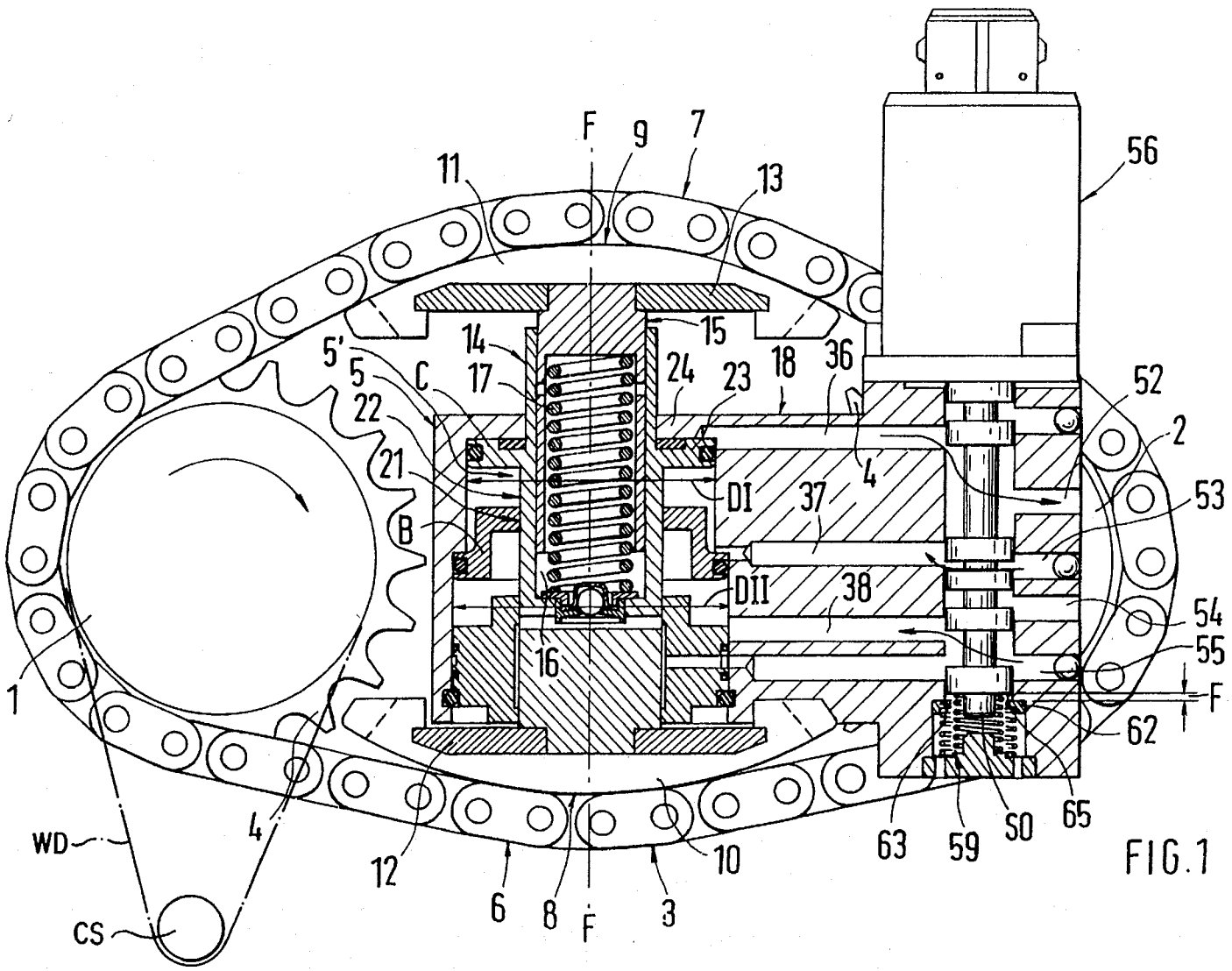
FIG. 1 is a partial sectional view of a camshaft drive adjusting system constructed according to a preferred embodiment of the present invention, shown in position for late opening of engine inlet valves.

An internal-combustion engine, which is not shown in detail, drives an outlet or exhaust valve control camshaft 1 by means of a crankshaft CS, a first wind-around drive WD—chain, belts—being provided for this purpose (crankshaft CS and wind-around drive WD shown schematically in dash lines in FIG. 1). In principle, this is illustrated in European Patent Document EP 0 445 356 which is taken into account here as the state of the art.

An inlet camshaft 2, which is driven by the outlet camshaft 1 by means of a chain 3, extends in parallel to the outlet camshaft 1. For each cylinder, the outlet camshaft 1 and the inlet camshaft 2 actuate two outlet or exhaust valves or two inlet valves, which are not shown. Both camshafts are arranged above a cylinder head and are provided with chain wheels 4 around which the chain 3 is wound.

The timing of the inlet valves is variable for optimizing the power and the torque, for which a device 5 is provided which has an adjusting device 5'. The device 5 is used for tightening the chain 3 and adjusting the inlet camshaft 2 relative to the outlet camshaft 1, whose position with respect to the crankshaft CS is in a form-locking manner determined by way of the wind-around drive WD. In addition, the device 5 is arranged between the load end 6 and the loose end 7 of the chain 3, in which case sliding blocks 10, 11, which are made of plastic, act upon the interior sides 8, 9 of the loose end 7 and of the load end 6. On the sides facing the load end 6 and the loose end 7, these sliding blocks 10, 11 have a radius-type course. The sliding blocks 10, 11 have a circular-segment-shaped basic form and are form-lockingly connected with adjacent plate-shaped carriers 12, 13; that is, the sliding blocks 10, 11 reach around the carriers 12, 13 in such a manner that the sliding blocks 10, 11 are to be connected with the carriers 12, 13 by being slid in.

Carrier 12 is firmly connected with a first hollow exterior hydraulic piston 14. Carrier 13 is firmly connected with a second interior, also hollow hydraulic piston 15 which is guided in the first hydraulic piston 14. In a hollow space 16 between the first hydraulic piston 14 and the second hydraulic piston 15, a prestressed, spiral-shape-type pressure spring 17 is provided.

Figure 2:
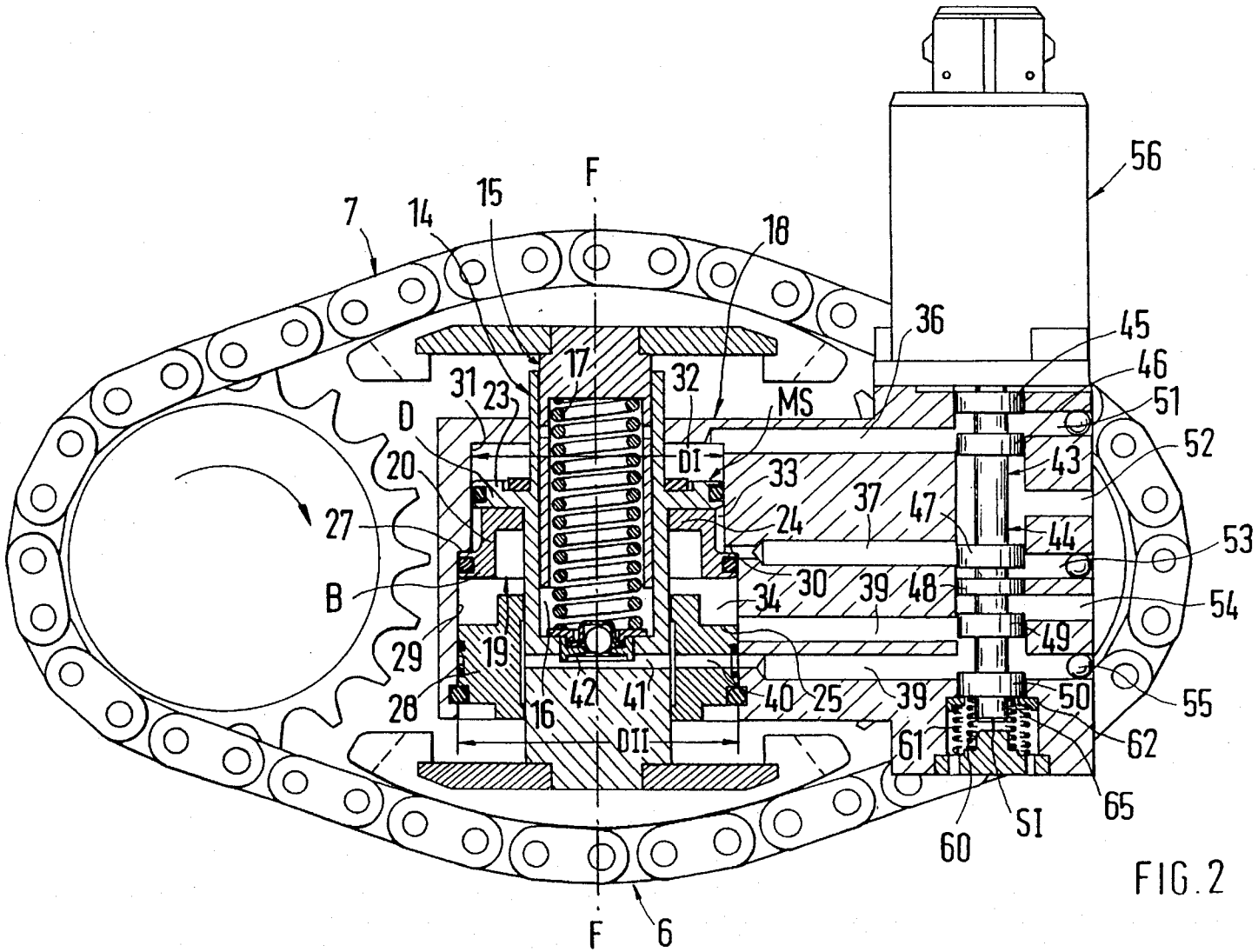
FIG. 2 is a view of the system of FIG. 1, shown in an intermediate position of opening of the engine intake valves.

The first hydraulic piston 14 and the second hydraulic piston 15 are installed in a housing 18, in which an adjusting device 19 is also arranged—FIG. 2—by means of which the first hydraulic piston 14 can be fixed in an intermediate position MS which may also be a position which is not precisely in the center. The adjusting device 19 is formed by a third hydraulic piston 20 which can be moved from initial position A FIG. 3—into operating position B—FIG. 1 and 2—and surrounds a guiding shaft 22 of the first hydraulic piston 14 by means of a bore 21.

The first hydraulic piston 14 comprises a cylindrical piston shoulder 23 and can be adjusted within positions C, D and E. In this case, Position C=late position (also initial position); inlet valves open late—FIG. 1—

Figure 3:
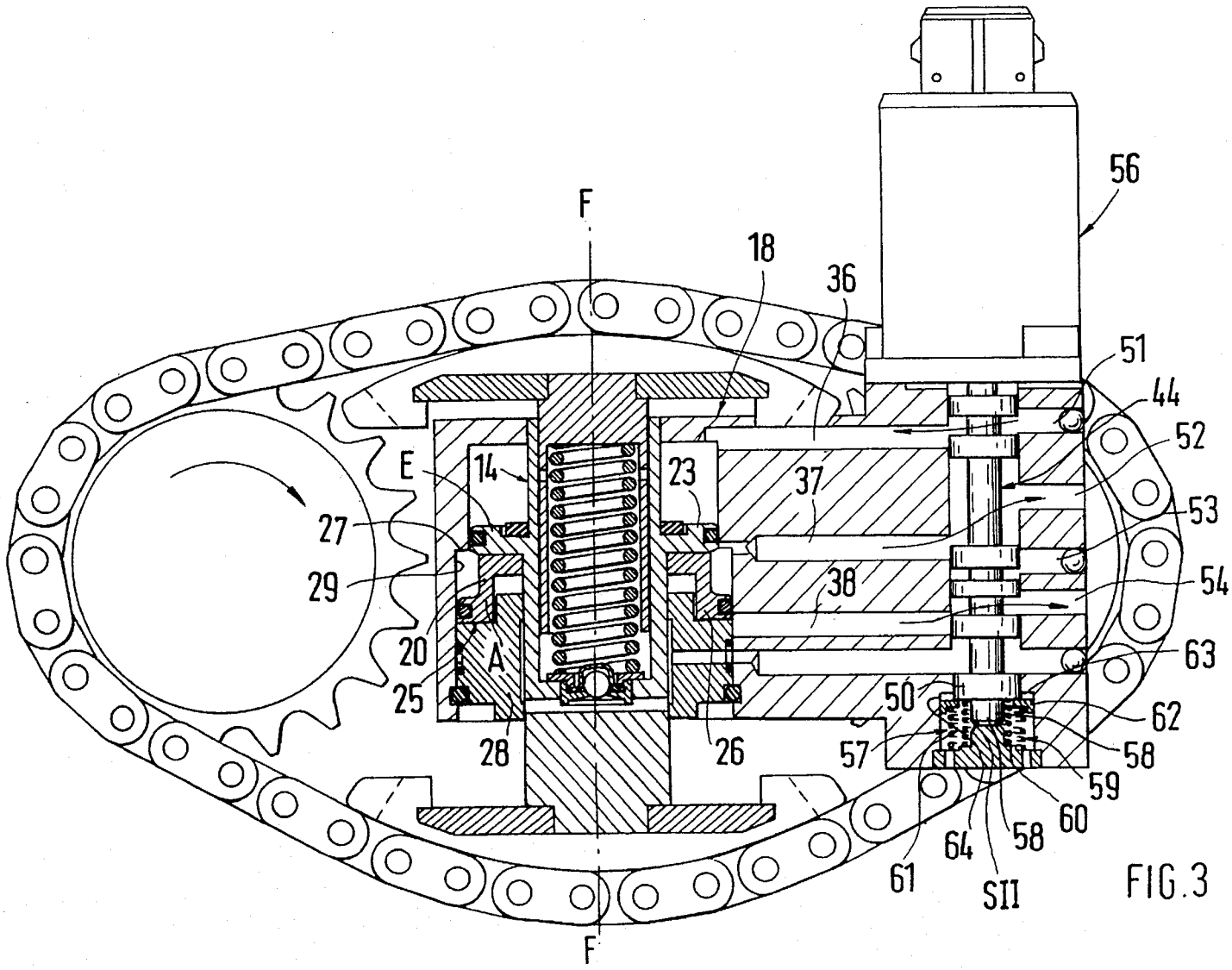
FIG. 3 is a view of the system of FIG. 1, shown in position for early opening of the engine inlet valves.

Position E=torque position; inlet valves open early —FIG. 3—

Position D—center position; optimized torque position between late position and early position—FIG. 2—.

In position C, the piston shoulder 23 of the first hydraulic piston 14 rests against a wall 24 of the housing 18 adjoining the loose end 7. In contrast, in position D, the piston shoulder 23 is supported on a piston bottom 24 of the third hydraulic piston 20 (operating position B). Although the same supporting conditions of piston shoulder 23 on piston bottom 24 occur in position E, the third hydraulic piston 20 is fixed against the housing in the initial position A.

In the initial position A (FIG. 3), the third hydraulic piston 20 is bounded by a first stop 25; that is a collar 26 of this hydraulic piston interacts with it. In contrast, in the operating position B (FIG. 2), the collar 26 rests against a second stop 27. In this case, the first stop 25 is provided on a closing part 28 of a first bore 29 of the housing 18 which is used for guiding the third hydraulic piston 20 or its collar 26. The second stop 27 is a projection 30 of the first bore 29. A second bore 31 extends behind the projection 30, which bore 31 extends coaxially to the first bore 29, its diameter D I being smaller than the diameter D II of the first bore 29. In the second bore 31, the piston shoulder 23 of the first hydraulic piston 14 is guided.

The first hydraulic piston 14 can be alternately acted on by hydraulic pressure from pressure spaces 32, 33 (FIG. 2). The third hydraulic piston 20 is acted upon from pressure space 33 and a pressure space 34.

The pressure spaces 32, 33, 34 are connected to operating lines AL - 36, 37, 38 (bored in the housing 18) which extend at a right angle with respect to the longitudinal center plane F—F of the device 5 or of the hydraulic pistons 14, 15, 20—FIG. 2. Another operating line 39 is connected by way of a connecting line 40 in the closing part 28 to a pressure space 41 from which, while overcoming a spherical valve 42, the hollow space 16 between the hydraulic pistons 14, 15 is continuously acted upon by hydraulic pressure during the operation of the internal-combustion engine. This hydraulic pressure and the pressure spring 17 secure a defined tension of the chain, specifically in the direction of the load end 6 and of the loose end 7.

For controlling the first hydraulic piston 14 and the third hydraulic piston 20, a 5/3-way valve 43 is used—5 connections, 3 switching positions—FIG. 2 (an additional oil pump is not required)—which has a piston rod 44 with several spaced pistons 45, 46, 47, 48, 49, 50, the pistons 45, 48, 50 having the guiding function, and the pistons 46, 47, 49 having the control function. As a function of the axial position of the piston rod 43, the pistons 47, 48 and 49 interact with the operating lines 36, 37, 38. In addition, the 5/3-way valve 43 has system lines—SL—51, 52, 53, 54, 55 in parallel to the operating lines—AL—36, 37, 38. Hydraulic pressure is fed by way of SL 51, 53 and 55; SL 52, 54 are used for the hydraulic return flow.

The 5/3-way valve 43 is integrated into the housing 18 and is provided with an electrically operated lifting magnet 56. The lifting magnet 56 is arranged coaxially with respect to the piston rod 44, a free end 57 of the piston rod 44 with the pin 58 and the piston 50 being aligned with a register spring arrangement 59—FIG. 3.

The register spring arrangement 59 comprises a first pressure spring 60 and a second pressure spring 61 which have different diameters and are placed into one another in sections. In this case, the first pressure spring 60, which, on the side facing away from the piston rod 44, surrounds a pin 61, is continuously supported on the piston 50. The second pressure spring 61 rests against a disk 62 which is tensioned against a projection 63 in a bore 64 and, when the lifting magnet 56 carries no current—FIG. 1—has an axial distance F to a stop surface 65 of the piston 50 —control position S 0—. When the lifting magnet 56 partially carries current (1 ampere), the stop surface 65 will rest against the disk 62 and the piston rod 44 will take up the control position S I—FIG. 2—. As soon as the lifting magnet 56 carries all the current (2 amperes), the piston 50 will bridge the disk 62, and the piston rod 44 will be in the control position S II; the maximal lift of the lifting magnet of approximately 2.1 mm is adjusted.

The following oil paths are obtained at positions C, D and E:

Position C; SL 53 and 55 in the direction AL 37 and 38 as well as AL 36 in the direction SL 52—FIG. 1—;

Position D; SL 51 in the direction AL 36 as well as AL 37 and 38 in the direction SL 52 and 54; —FIG. 3—;

Position E; SL 51 and 55 in the direction AL 36 and 38 as well as AL 37 in the direction SL 52; —FIG. 2—.

Figure 4:
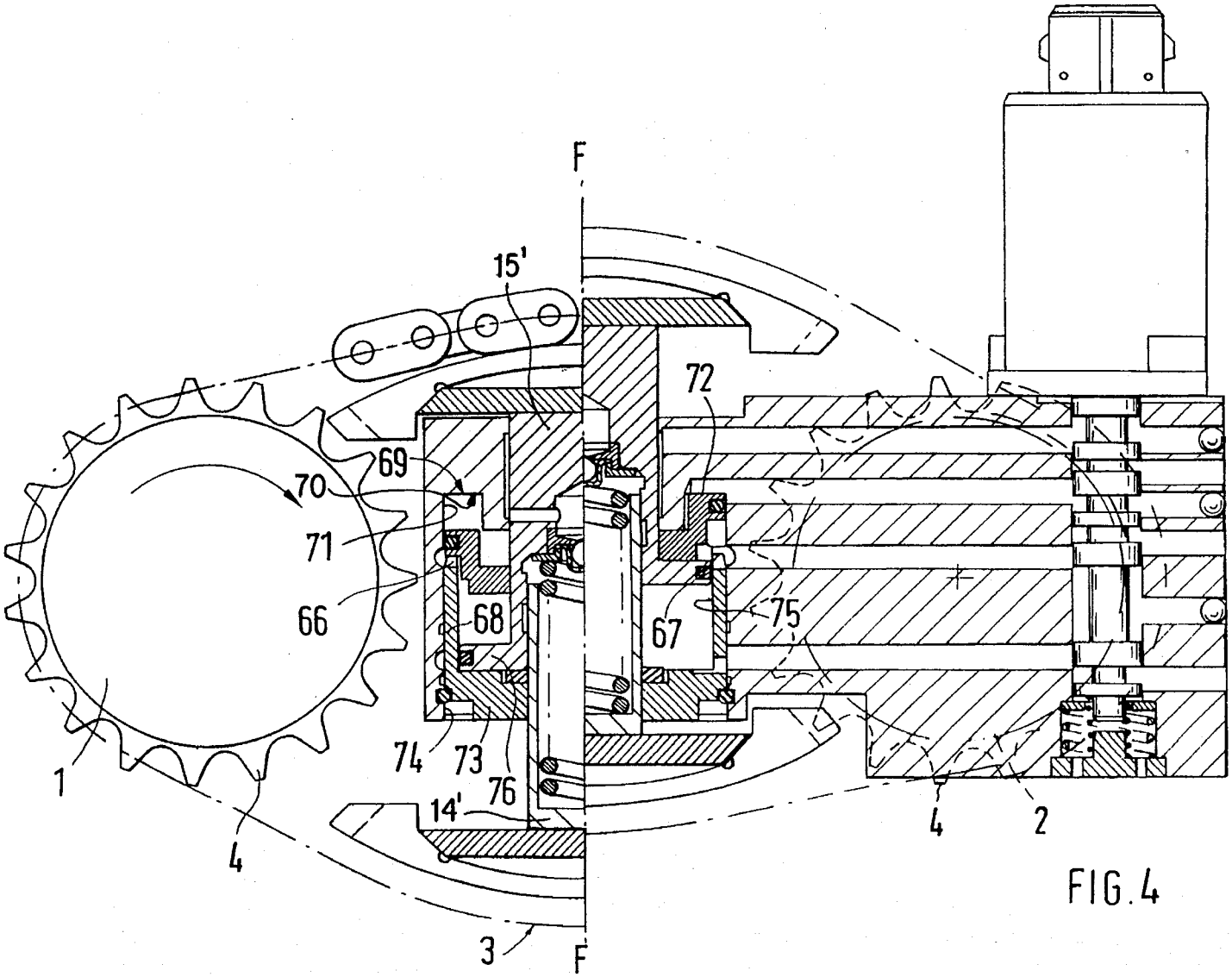
FIG. 4 is a view corresponding to FIG. 1, showing another embodiment of the invention with the right and left hand portions of this FIG. 4 depicting different adjusted positions of the system.

Unless otherwise described below, the embodiment of FIG. 4 is basically similar to the embodiment of FIGS. 1–3. In FIG. 4, the piston 14' is telescopically guided inside the piston 15', in contrast to the reverse arrangement of the pistons 14 and 15 of the embodiment of FIGS. 1–3. The third hydraulic piston 72 serves as the adjusting piston. According to FIG. 4, a second stop 66 is a free end 67 of a piston shaft 68 fixed in the housing. The first stop 69 is a bounding surface 70 of a bore 71 of the housing which limits the position of the adjusting piston 72. The piston shaft 68 is provided on a cup-shaped piston 73, which is a fixed closing part disposed in a bore 74 of the housing. The interior side 75 of the piston shaft 68 is constructed as a guide bore for a first hydraulic piston section 76 of piston 15'.

Figure 5:
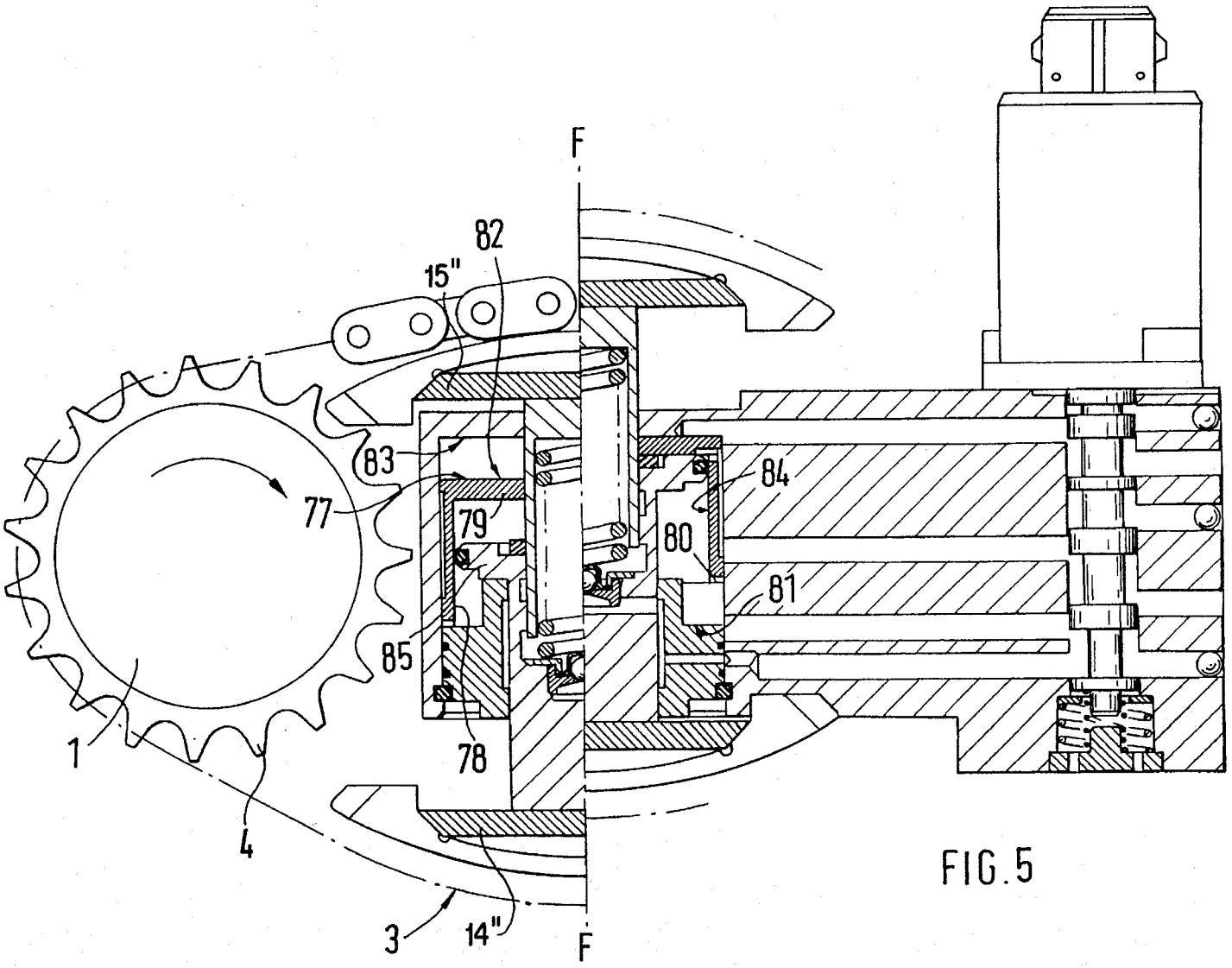
FIG. 5 is a view corresponding to FIG. 1 showing yet another embodiment of the invention with the right and left hand portions of this FIG. 5 depicting different adjusted positions of the system.

Unless otherwise described below, the embodiment of FIG. 5 is basically similar to the embodiment of FIG. 1–3. In FIG. 5, the piston 14" is telescopically guided on the outside of the piston 15", generally similar to the embodiment of FIGS. 1–3.

In FIG. 5, the third adjusting hydraulic piston 77 has a piston shaft 78 and a piston bottom 79. According to the position of the hydraulic piston 77, a free end 80 of the piston shaft 78 interacts with a second stop 81 (left hand side of FIG. 5) and an exterior side 82 of the piston bottom 79 interacts with a first stop 83 (right hand side of FIG. 5). In this case, an interior side 84 of the piston shaft 78 is constructed as a guide bore for a first hydraulic piston part 85 of the piston part 14".

Description of Operation

During the operation of the internal-combustion engine in the cold condition (<40° C.), the adjusting device 5 of the preferred embodiment shown in FIGS. 1–3 operates only as a tightener. If this temperature is exceeded, the following positions of the device 5 are obtained as a function of operating parameters:

1. Between idling and 1,500/min (1,500 revolutions per minute) position C=late position; lifting magnet 52 has position S 0—FIG. 1—.

2. After 1,500/min to 4,500/min position D=early position; lifting magnet 52 has control position S II—FIG. 3—.

3. After 4,500/min to 6,000/min intermediate position; lifting magnet 52 has control position S I—FIG. 2—.

4. Above 6,000/min late position; lifting magnet has control position S 0—FIG. 1—.

The above-mentioned rotational speed data are exemplary values which can be varied according to the type of internal-combustion engine for the specific requirements in a more or less pronounced form, in which case additional parameters such as load (gas pedal position), oil temperature or the like may be taken into account. All parameters are fed to an engine control unit - computer - which transmits corresponding control quantities to the lifting magnet 52.

During the adjusting operations, the hydraulic pistons 14, 15 and 20 are displaced transversely with respect to the interior sides 8 and 9 to the chain 3 in such a manner that the loose end 7 of the chain is lengthened and the load end 6 is shortened or the load end 6 is shortened and the loose end 7 is lengthened. In this case, the position of the outlet camshaft 1 with respect to the crankshaft remains constant because they are in a driving connection, whereas the inlet camshaft 2 is rotated relative to the outlet camshaft 1. The valve timing will therefore change.

The embodiment of FIGS. 4 and 5 are operated in a similar manner as described above for the embodiment of FIGS. 1–3.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Device for tightening and adjusting a wind-around drive constructed as a chain by means of which a camshaft of an internal-combustion engine drives a second camshaft, by adjusting the chain by means of an adjusting device acting transversely to the chain, the relative position of the camshafts with respect to one another being changed, said adjusting device is displaced for adjusting the chain in such a manner that either a loose end of the chain is lengthened and a loaded end is shortened or the loose end is shortened and the loaded end is lengthened and furthermore the adjusting device is actuated hydraulically, said adjusting device includes a first hollow exterior hydraulic piston, a second interior, also hollow hydraulic piston guided within said first piston and a pressure spring tensioned in the hydraulic space between the two hydraulic pistons, in addition to the force of the pressure spring, the hydraulic pistons being continuously acted upon by way of a pressure connection between the two hydraulic pistons by hydraulic pressure, said first hydraulic piston by way of pressure ducts can be alternately acted upon by hydraulic pressure, the hydraulic pistons being disposed in a housing, wherein the first hydraulic piston can be fixed in an intermediate position by means of an adjusting device, wherein the adjusting device comprises a third hydraulic piston which surrounds the first hydraulic piston and which can be alternately acted upon by hydraulic pressure in such a manner that the third hydraulic piston can be moved between an initial position and an operating position which fixes the first hydraulic piston in the intermediate position.

2. Device according to claim 1, wherein said first and second pistons are telescopically guidingly engaged with one another, and wherein said third hydraulic piston is telescopically guided on one of the first and second pistons.

3. Device according to claim 1, wherein the third hydraulic piston is fixed in the initial position by a first stop and in the operating position by a second stop.

4. Device according to claim 3, wherein the first stop is provided on a closing part of a first bore of the housing for the third hydraulic piston, whereas the second stop is a projection in the bore.

5. Device according to claim 4, wherein a second bore for the first piston is provided coaxially to the first bore, the diameter of the piston being slightly smaller than the diameter of the first bore.

6. Device according to claim 3, wherein the second stop is formed by a free end of a piston shaft, whereas the first stop is a boundary surface of a bore for the third hydraulic piston.

7. Device according to claim 6, wherein a cup-type piston of the piston shaft is illustrated as a fixed closing part of the bore of the third hydraulic piston.

8. Device according to claim 7, wherein the interior side of the piston shaft is constructed as a guide bore for the first hydraulic piston.

9. Device according to claim 1, wherein the third hydraulic piston comprises a piston shaft and a piston bottom, a free end of the piston shaft interacting with the second stop and the exterior side of the piston bottom interacting with the first stop.

10. Device according to claim 9, wherein the interior side of the piston shaft is constructed as a guide bore for the first hydraulic piston.

11. Device according to claim 1, wherein the control of the hydraulic pistons takes place by means of a 5/3-way valve.

12. Device according to claim 11, wherein the 5/3-way valve is integrated in the housing.

13. Device according to claim 12, wherein the 5/3-way valve is constructionally combined with a lifting magnet, a piston rod of the 5/3-way valve extending coaxially with respect to the lifting magnet.

14. Device according to claim 13, wherein the piston rod is supported by means of a piston on a first pressure spring when the lifting magnet carries no current, whereas, when the lifting magnet carries partial current, for the intermediate position of the first hydraulic piston, the piston is supported on a second pressure spring.

15. Variable valve timing system for an internal combustion engine having first and second cam shafts drivingly connected by an endless drive chain, comprising:

a housing, first and second opposed hydraulic pistons displaceably disposed in the housing and operable to adjust the drive chain by lengthening and shortening respective load and loose ends of the drive chain, and an adjuster engageable with one of said first and second pistons to adjust the position of said one of said first and second pistons with respect to said housing, wherein said adjuster includes a third hydraulic piston engageable with said one of said first and second pistons and operable to move the same in response no hydraulic pressure on the third hydraulic piston.

16. Variable valve timing system according to claim 15, wherein a common hydraulic fluid pressure source is provided for controlling the position of all three pistons as a function of engine operating conditions.

* * * * *